US007156244B1

(12) United States Patent
Nelsen

(10) Patent No.: US 7,156,244 B1
(45) Date of Patent: Jan. 2, 2007

(54) CANTILEVERED DRAWER CONSTRUCTION

(76) Inventor: Randall Nelsen, 7775 Creekwood Dr., Alto, MI (US) 49302

( * ) Notice: Subject to any disclaimer, the term of this patent is extended or adjusted under 35 U.S.C. 154(b) by 0 days.

(21) Appl. No.: 11/163,077

(22) Filed: Oct. 4, 2005

Related U.S. Application Data

(60) Provisional application No. 60/522,469, filed on Oct. 4, 2004.

(51) Int. Cl.
*A47F 5/12* (2006.01)

(52) U.S. Cl. ..... 211/169; 211/168; 211/79; 211/80; 211/46; 312/310; 312/322

(58) Field of Classification Search ..... 211/169, 211/171, 99, 164, 80, 79, 163, 133.1, 46, 211/162.15; 312/323, 322, 334.12, 334.18, 312/310; D25/61; 269/71, 73
See application file for complete search history.

(56) References Cited

U.S. PATENT DOCUMENTS 2,286,372 A * 6/1942 Page ..... 297/330
2,492,697 A * 12/1949 Higley ..... 312/322
2,566,186 A * 8/1951 Gillett ..... 312/323
2,716,583 A * 8/1955 Straubel ..... 312/303
3,929,387 A * 12/1975 Grass ..... 384/19
4,842,348 A * 6/1989 Ackeret ..... 312/9.58
6,234,595 B1 * 5/2001 Maple et al. ..... 312/323
2005/0248245 A1 * 11/2005 Ceccarelli et al. ..... 312/323

* cited by examiner

*Primary Examiner*—Richard E. Chilcot, Jr.
*Assistant Examiner*—Lindsay M. Maguire
(74) *Attorney, Agent, or Firm*—McGarry Bair PC

(57) ABSTRACT

A cantilevered drawer assembly comprises a support frame assembly comprising a pair of upright members. A rotating drawer assembly comprises a drawer frame having opposed parallel side rails supported upon a pivot frame having a pair of opposed pivot wheels. A pair of circular sector-shaped pivot arms is attached to the upright members. A channel having a parabolic section and a pair of straight sections extends across each pivot arm, and receives a pivot wheel. The side rails of the drawer frame are supported by the pivot arms. A pair of flanged wheels engages an upper edge of each side rail to restrict the vertical movement of the drawer frame. Translation of the drawer frame relative to the support frame assembly is accompanied by pivoting of the pivot arms. During translation, the drawer frame remains in a horizontal plane and is held in a cantilevered configuration.

3 Claims, 17 Drawing Sheets

CANTILEVERED DRAWER CONSTRUCTION

CROSS-REFERENCE TO RELATED APPLICATION

This application claims the benefit of U.S. provisional application Ser. No. 60/522,469, filed Oct. 4, 2004, which is incorporated herein in its entirety.

FIELD OF THE INVENTION

The invention relates generally to drawers and in one aspect to an assembly for supporting a drawer in a cantilevered manner when the drawer is moved from a stored position to an accessible position. In another aspect the invention relates to a movable support mechanism for a drawer which does not extend the length of the drawer. In another aspect the invention relates to a movable support mechanism which does not require mounting of the drawer in a cabinet.

DESCRIPTION OF THE RELATED ART

Drawers are ubiquitous and indispensable for storage of a wide variety of items. In particular, conventional offices and workspaces utilize cabinets, tables, built-in units, and the like for storage of a variety of work-related items, such as files, writing tools, stationery, and the like. The weight that must be carried by a drawer can vary considerably depending upon whether the drawer must support heavily-laden files or small desktop items. Thus, such drawers typically will be supported on sturdy movable hardware having multiple moving parts which must be fabricated and assembled to close tolerances in order to perform satisfactorily. Such hardware is expensive to manufacture and install.

Typical office or workspace drawers are designed to be accessed from one side of the storage unit in which the drawer is installed. Thus, the drawer will only be required to translate in one direction. However, there are many installations in which it is desirable for the drawer to be accessed from two opposite sides. This requires special movable hardware to enable the drawer to translate in two directions. Such hardware is particularly expensive to manufacture and install.

SUMMARY OF THE INVENTION

A cantilevered drawer assembly comprises a movable drawer frame having two side rails and two end rails interconnected to form a rectilinear frame. A pivot frame comprises at least two members interconnected at first ends to define a vertex and connected at second ends to the movable drawer frame. The pivot frame further comprises a rotating wheel attached to the interconnected first ends at the vertex. A pivot arm assembly comprises a pivot arm, the pivot arm having the shape of a circular sector with an apex portion. A channel traverses the pivot arm and has a parabolic shape opening away from the apex. A support frame assembly comprises a pair of upright members for supporting the movable drawer frame. The pivot arm is pivotally connected at the apex portion to an upright member. When the movable drawer frame and the pivot arm assembly are attached to the upright members, the rotating wheel is received in the parabolic channel so that the wheel moves along the parabolic channel as the pivot arm rotates about the apex portion, thereby enabling the movable drawer frame to translate in a plane relative to the support frame assembly.

A side rail is supported by the pivot arm. The cantilevered drawer assembly can further comprise a flanged wheel rotatably attached to an upright member to engage an upper edge of each side rail to restrict the vertical movement of the drawer frame.

DESCRIPTION OF AN EMBODIMENT OF THE INVENTION

Figure 1:
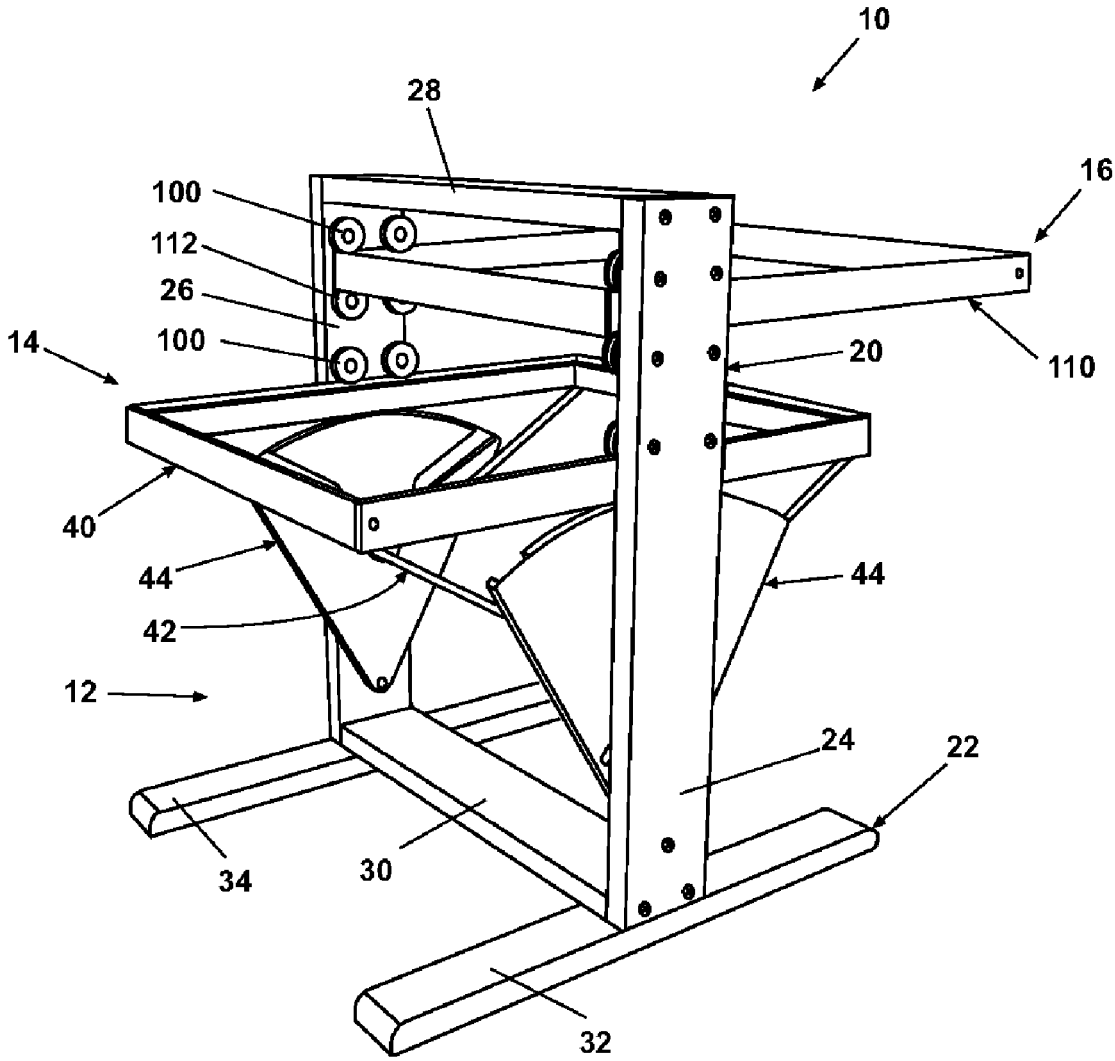
FIG. 1 is a perspective view of a cantilevered drawer assembly comprising a support frame assembly supporting a rotating drawer assembly and a sliding drawer assembly according to the invention.

Referring now to the figures and in particular to FIG. 1, an embodiment of the invention comprising a cantilevered drawer assembly 10 is illustrated. The cantilevered drawer assembly 10 is shown comprising a support frame assembly 12, a rotating drawer assembly 14, and a sliding drawer assembly 16. As will be described hereinafter, the cantilevered drawer assembly 10 can comprise a support frame assembly 12 and a plurality of rotating drawer assemblies 14, a support frame assembly 12 and a plurality of sliding drawer assemblies 16, or a support frame assembly 12 and a mixture of rotating drawer assemblies 14 and sliding drawer assemblies 16. Alternatively, the support frame assembly 12 can be replaced by a conventional cabinet or other support structure supporting rotating drawer assemblies 14 and/or sliding drawer assemblies 16.

The support frame assembly 12 comprises a center frame 20 supported upon a base 22. The center frame 20 comprises a pair of elongated upright members 24, 26 rigidly interconnected by a pair of elongated crossmembers 28, 30 to form a generally rectilinear frame having vertical and horizontal dimensions adapted for receipt of the rotating drawer assemblies 14 and sliding drawer assemblies 16 as hereinafter described. The upright members 24, 26 and the crossmembers 28, 30 can comprise solid or hollow pieces having suitable strength and rigidity for the purposes described herein.

The base 22 is illustrated comprising a pair of feet 32, 34 extending laterally away from the center frame 20 a sufficient distance to provide lateral stability to the cantilevered drawer assembly 10. Alternatively, the base 22 can comprise a plate-like member, or can be eliminated entirely, with the center frame 20 attached to and supported directly upon a support surface, such as a floor or elevated surface.

Figure 2:
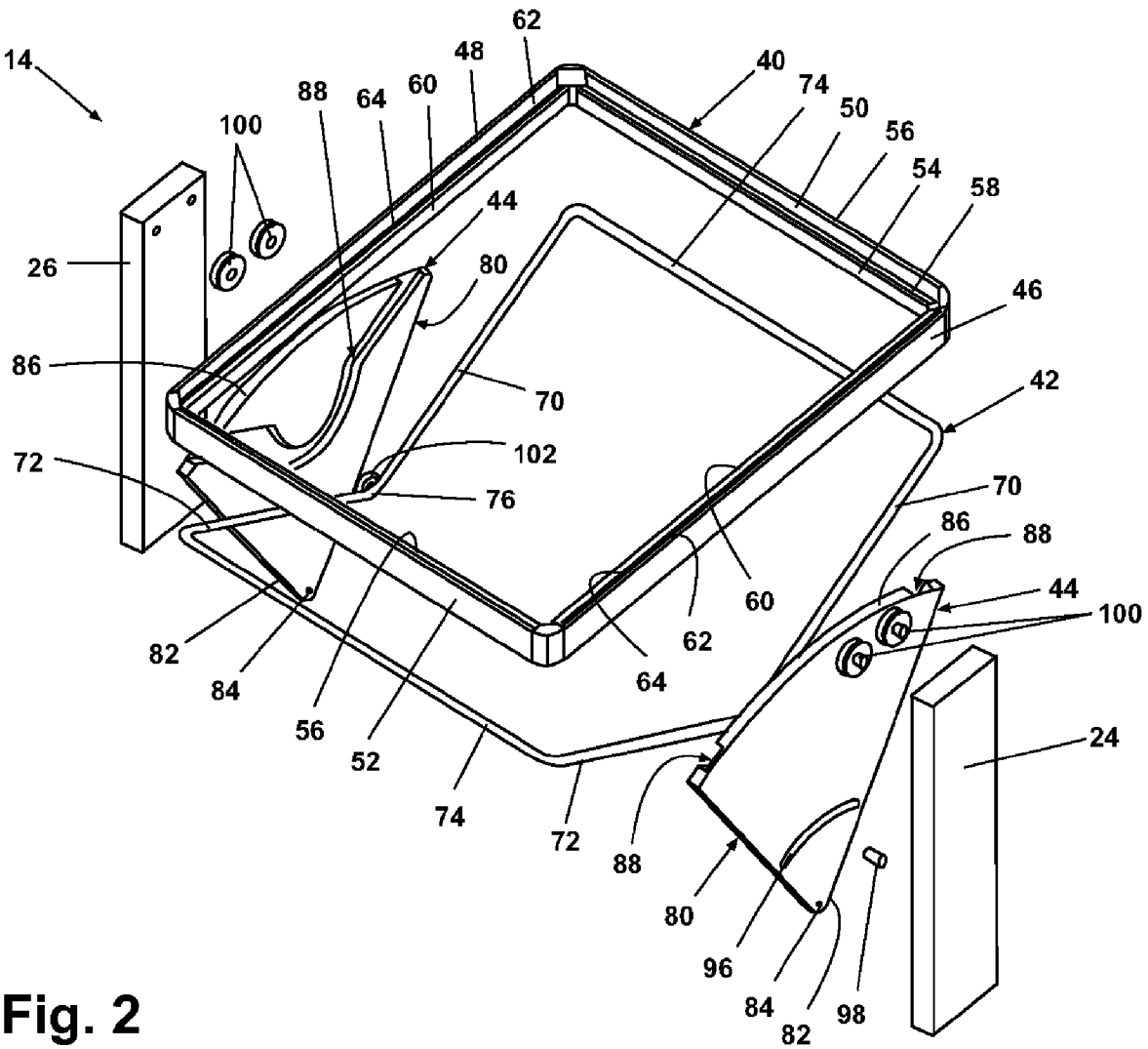
FIG. 2 is an exploded view of the rotating drawer assembly illustrated in FIG. 1.

Referring also to FIG. 2, the rotating drawer assembly 14 comprises a drawer frame 40, a pivot frame 42, and a pivot arm assembly 44. The drawer frame 40 is a generally rectilinear open-framed structure comprising a pair of side rails 46, 48 rigidly interconnected with a pair of end rails 50, 52. The side rails 46, 48 are relatively thin, elongated members comprising a base portion 54 having a rectilinear cross-section and a flange portion 56 extending upwardly from and along an outer edge of the base portion 54 to define a rabbet-like ledge 58 along the top of the base portion 54. The end rails 50, 52 are relatively thin, elongated members comprising a base portion 60 having a rectilinear cross-section and a flange portion 62 extending upwardly from and along an outer edge of the base portion 60 to define a rabbet-like ledge 64 along the top of the base portion 60. The side rails 46, 48 and the end rails 50, 52 are rigidly connected to form the rectilinear drawer frame 40 having a continuous ledge around an inner perimeter thereof and a continuous flange around an outer perimeter thereof. One or more discontinuities on the flange may be helpful to remove the drawer frame from the assembly. For example, a scallop at the corners may make it easier to move the frame past roller wheels (see below).

The pivot frame 42 is an essentially rectilinear frame-like structure having a V-shaped profile. The pivot frame 42 comprises a pair of parallel inclined members 70 connected by a first crossmember 74, and a pair of parallel inclined members 72 connected by a second crossmember 74 parallel to and spaced away from the first crossmember 74. The inclined members 70 are connected to the inclined members 72 through a bight portion 76 to form the V-shaped closed frame structure of the pivot frame 42. The bight portion 76 is adapted for connection of a pivot wheel 102, as hereinafter described. The pivot frame 42 is adapted so that the crossmembers 74 engage the end rails 50, 52 to support the drawer frame 40 with the bight portions 76 extending downwardly away from the drawer frame 40. The crossmembers 74 are fixedly attached to the end rails 50, 52 through a suitable means, such as slots in the end rails 50, 52, clips, and the like.

Figure 3:
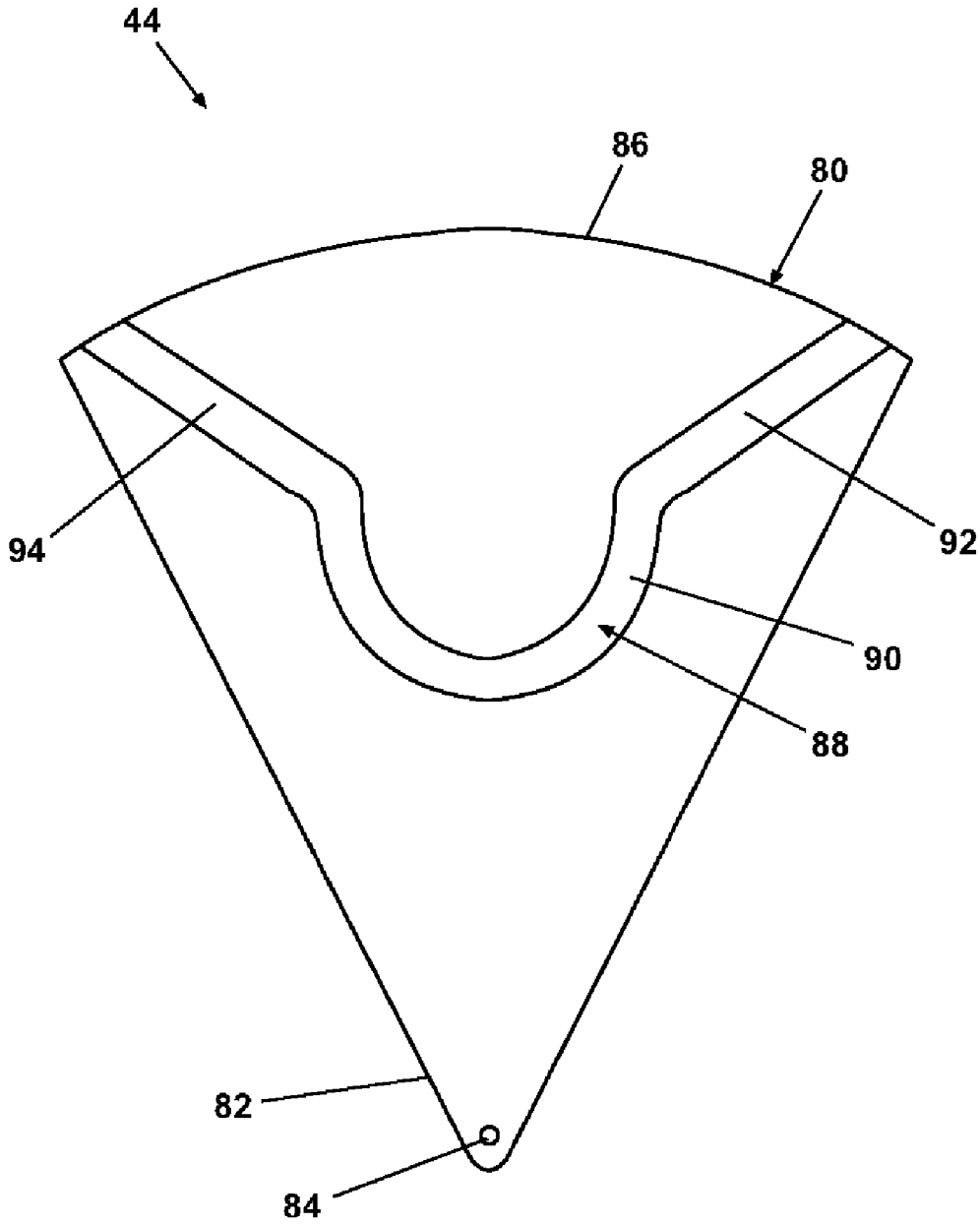
FIG. 3 is a side elevation view of a pivot arm comprising a portion of the rotating drawer assembly illustrated in FIG. 2.

Referring also to FIG. 3, the pivot arm assembly 44 comprises a circular sector shaped pivot arm 80. The pivot arm 80 is a platelike body having an apex 82 with a pivot aperture 84 extending therethrough, and an opposed arcuate edge 86. A channel 88 traverses the pivot arm 80 along an obverse side 85 toward the arcuate edge 86, and comprises a parabolic section 90 transitioning from both arms of the parabolic section to straight sections 92, 94. The parabolic section 90 opens away from the apex 82, and has its directrix collinear with the longitudinal bisecting axis of the pivot arm 80. The straight sections 92, 94 intersect the arcuate edge 86 near the endpoints thereof. An arcuate slot 96 traverses the pivot arm 80 along a reverse side 87 toward the vertex 82 parallel to the arcuate edge 86. The arcuate slot 96 terminates just short of the straight edges of the pivot arm 80. It will be understood that the straight sections 92, 94 may not be needed, depending upon the size of the parabolic section 90. In other words, the larger the parabolic section 90, the smaller the straight sections 92, 94 can be for the same amount of translation of the drawer frame 40. However, a larger parabolic section 90 may require a larger pivot arm 80.

The pivot arm 80 is pivotably attached to an upright member 24, 26 through a suitable conventional pivot fastener (not shown), such as a threaded fastener, inserted through the pivot aperture 84 into the upright member 24, 26. As illustrated in FIG. 2, a pin 98 is fixedly attached to an upright member 24, 26 above the pivot fastener and is adapted for slidable receipt in the arcuate slot 96 when the pivot arm 80 is attached to the upright member 24, 26. The pin 98 prevents the pivot arm 80 from pivoting beyond a selected angular displacement as a consequence of the pin 98 engaging the end of the arcuate slot 96.

Figure 4:
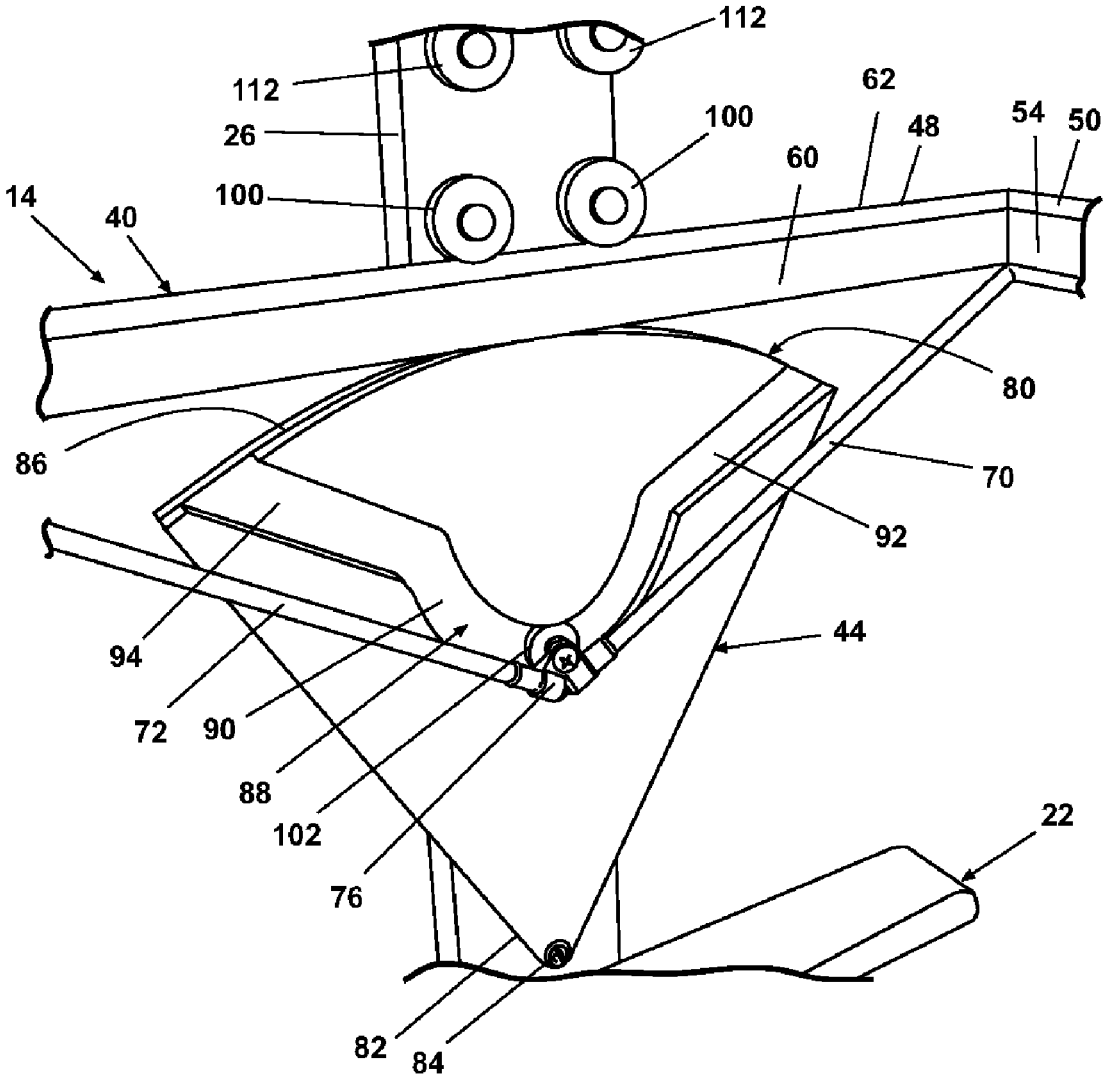
FIG. 4 is an enlarged perspective view of a portion of the rotating drawer assembly illustrating the pivot arm in a "neutral" position.

Referring to FIG. 4, the bight portion 76 of the pivot frame 42 is adapted for rotatable attachment of a pivot wheel 102. As illustrated in FIG. 4, the bight portion 76 can be provided through a bracket assembly that interconnects the inclined members 70, 72 and provides a connection for the pivot wheel 102. Alternatively, the bight portion 76 can be formed from a bend in a single elongated member to form the inclined members 70, 72, with a bracket attached to the bight portion 76 for connecting the pivot wheel 102. In any case, the pivot wheel 102 is oriented to face outwardly of the pivot frame 42.

The length of the crossmembers 28, 30 is adapted to accommodate the width of the drawer frame 40. Preferably, the end rails 50, 52 of the drawer frame 40 have a length somewhat shorter than the length of the crossmembers 28, 30 to enable the drawer frame 40 to translate within the support frame assembly 12 while limiting the lateral movement of the drawer frame 40 between the upright members 24, 26. Referring also to FIG. 4, the drawer frame 40 is positioned between the upright members 24, 26 so that the side rails 46, 48 rest on the arcuate edge 86 of the pivot arm 80. A pair of roller wheels 100 is rotatably attached to the upright members 24, 26 above the pivot arms 80 for engaging the flange portion 62 of the side rails 46, 48. The roller wheels 100 comprise an inner flange 104 and an outer flange 106 defining a channel 108 therebetween. The roller wheels 100 are rotatably attached to the upright members 24, 26 so that the flange portion 62 is received within the channel 108. The roller wheels 100 are illustrated arranged in pairs, although a fewer or greater number of roller wheels 100 can be used.

Figure 5:
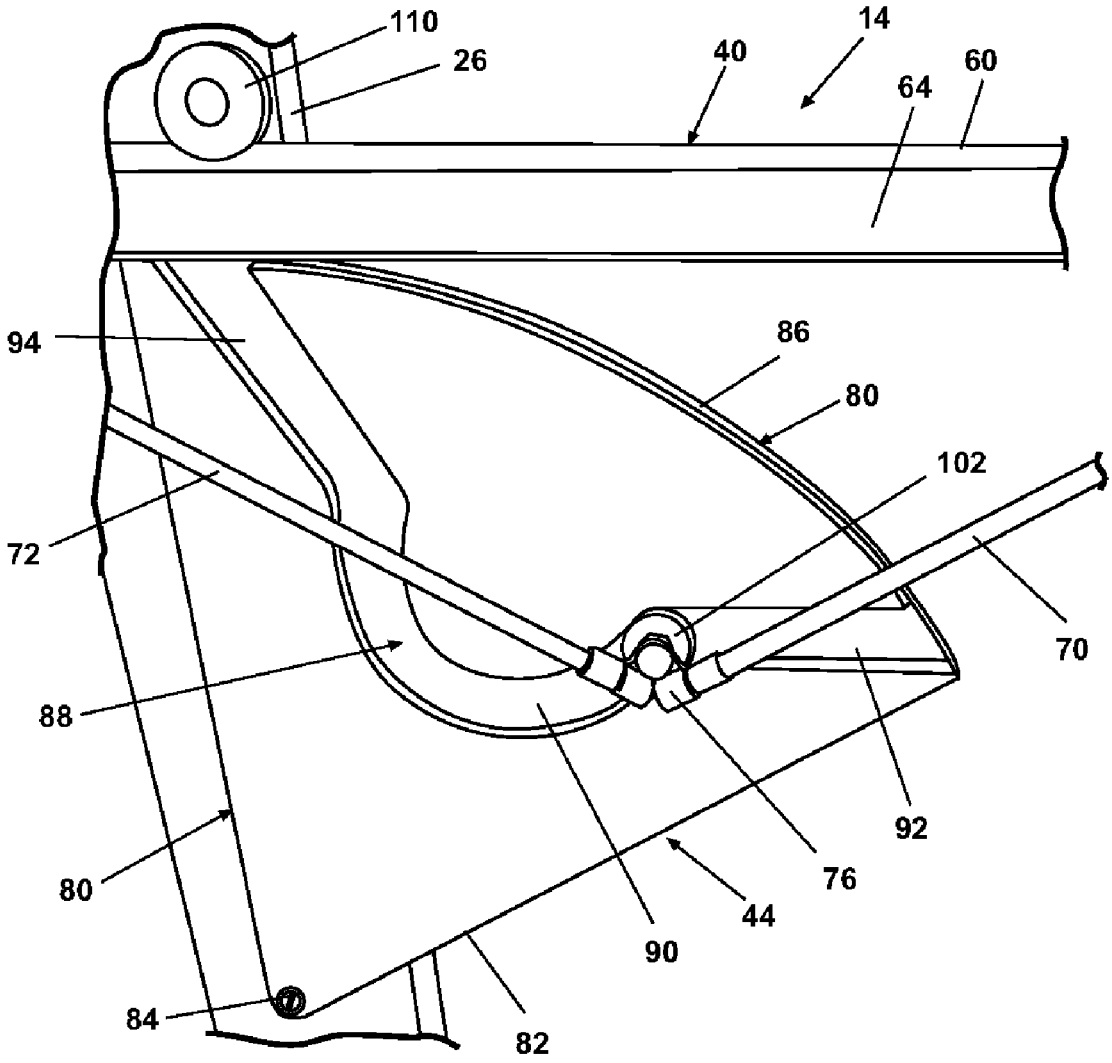
FIG. 5 is an enlarged perspective view of the portion of the rotating drawer assembly illustrated in FIG. 4 with the pivot arm in a partially translated or accessible position, the drawer being translated in a first direction.
Figure 7:
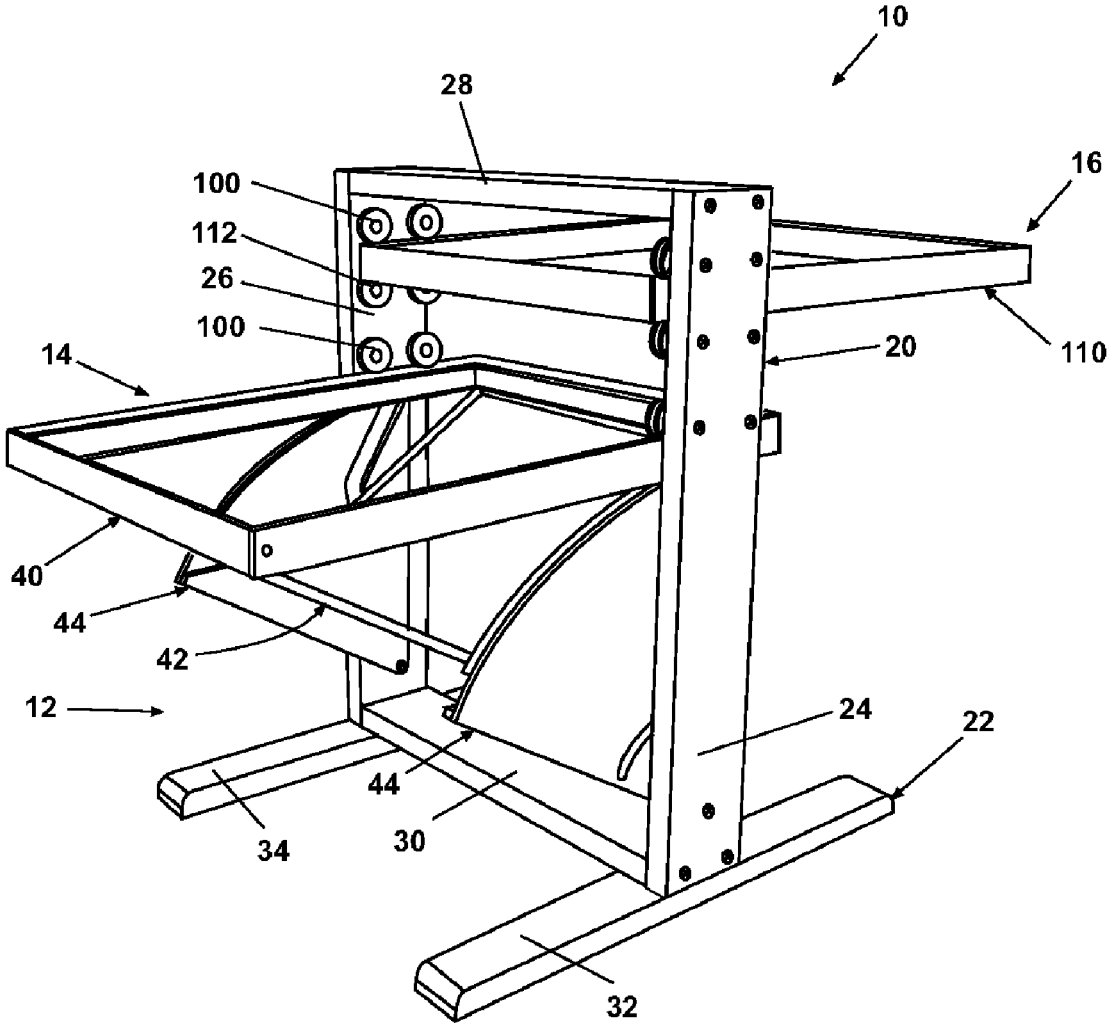
FIG. 7 is a perspective view of the cantilevered drawer assembly illustrated in FIG. 1 with the rotating drawer assembly fully translated in the second direction, and the sliding drawer assembly fully extended in a first, opposed direction.

The configuration of the drawer frame 40, the pivot frame 42, the pivot arm assembly 44, and the roller wheels 100 is adapted so that, when the drawer frame 40 rests upon the arcuate edge 86 of the pivot arm 80 and the flange portion 62 is received within the channels 108 of the roller wheels 100, the pivot wheel 102 is received within the channel 88, as illustrated in FIG. 4. As illustrated in FIGS. 5 and 7, translation of the drawer frame 40 away from the support frame assembly 12 will urge the pivot wheel 102 along the parabolic section 90 of the channel 88. This movement will urge the rotation of the pivot arm 80 about the pivot connection from a vertical position to an inclined position, while maintaining the arcuate edge 86 in contact with the end rail 50, 52. The roller wheels 100 will maintain the end rail 50, 52 in contact with the arcuate edge 86, and the drawer frame 40 will translate in a horizontal plane.

Figure 6:
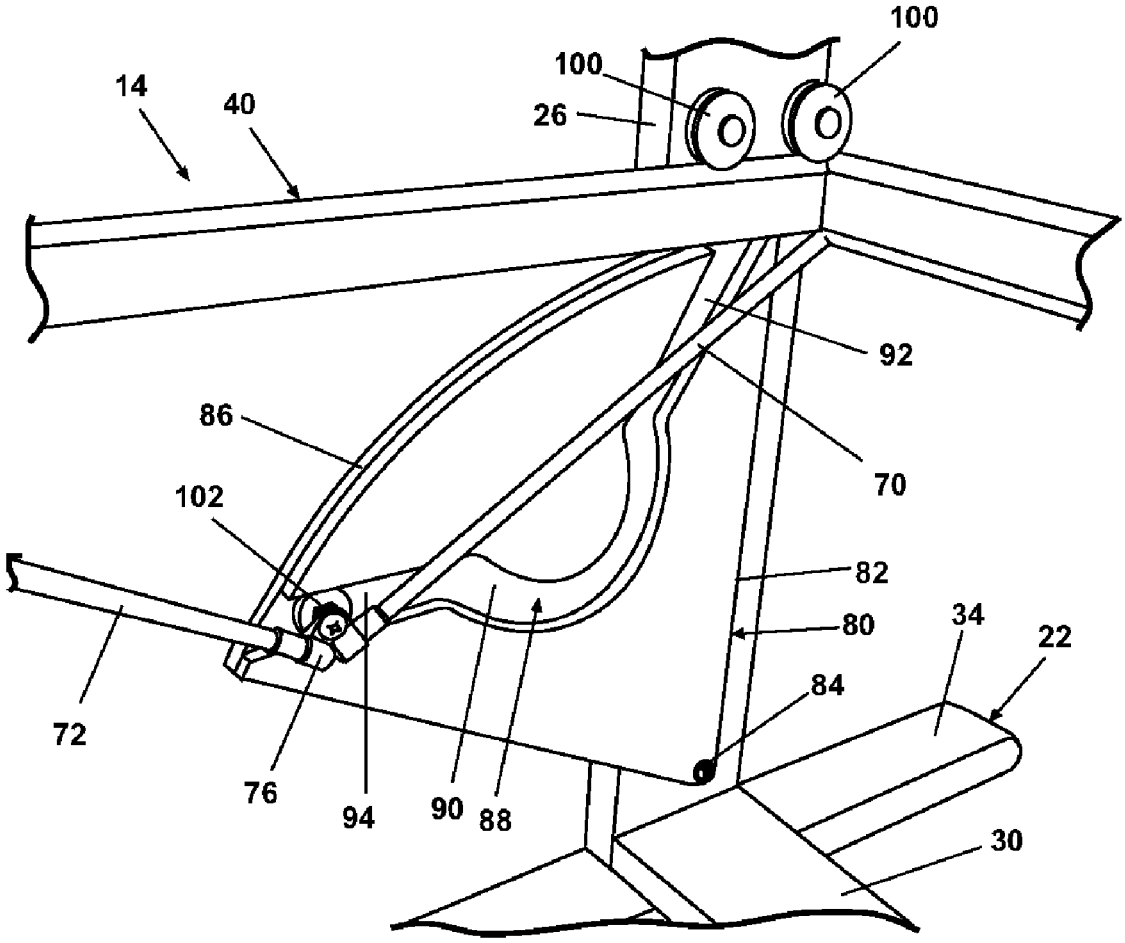
FIG. 6 is an enlarged perspective view of the rotating drawer assembly illustrated in FIG. 4 with the pivot arm in a fully translated or accessible position, the drawer being translated in a second direction opposed to the first direction.

Referring to FIG. 6, further translation of the drawer frame 40 away from the support frame assembly 12 will urge the pivot wheel 102 along the straight section 92, 94 of the channel 88. The drawer frame 40 will remain in a horizontal plane. Further rotation of the pivot arm 80 will be prevented by the pin 98 contacting the end of the arcuate slot 96. When the pivot arm 80 is rotated to its stopped position, along with the pivot frame 42 it will act as a strut to hold the drawer frame 40 in a cantilevered position. Translation of the drawer frame 40 back toward the support frame assembly 12 will urge the movement of the pivot wheel 102 along the straight section 92, 94, followed by movement of the pivot wheel 102 along the parabolic section 90 and rotation of the pivot arm 80 to a vertical position.

Figure 8:
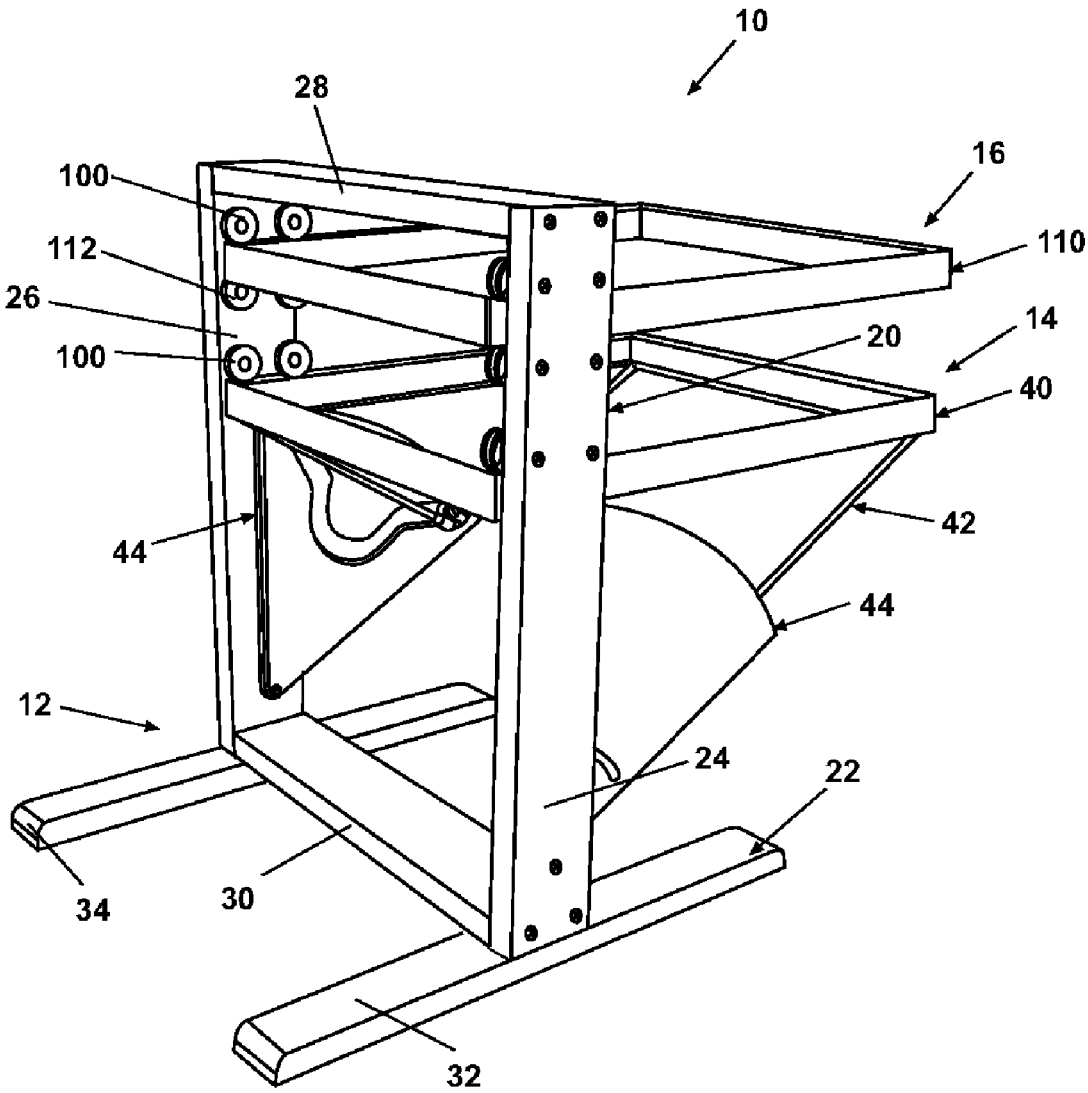
FIG. 8 is a perspective view of the cantilevered drawer assembly illustrated in FIG. 7 with both the rotating drawer assembly and the sliding drawer assembly fully translated in the first direction.
Figure 9:
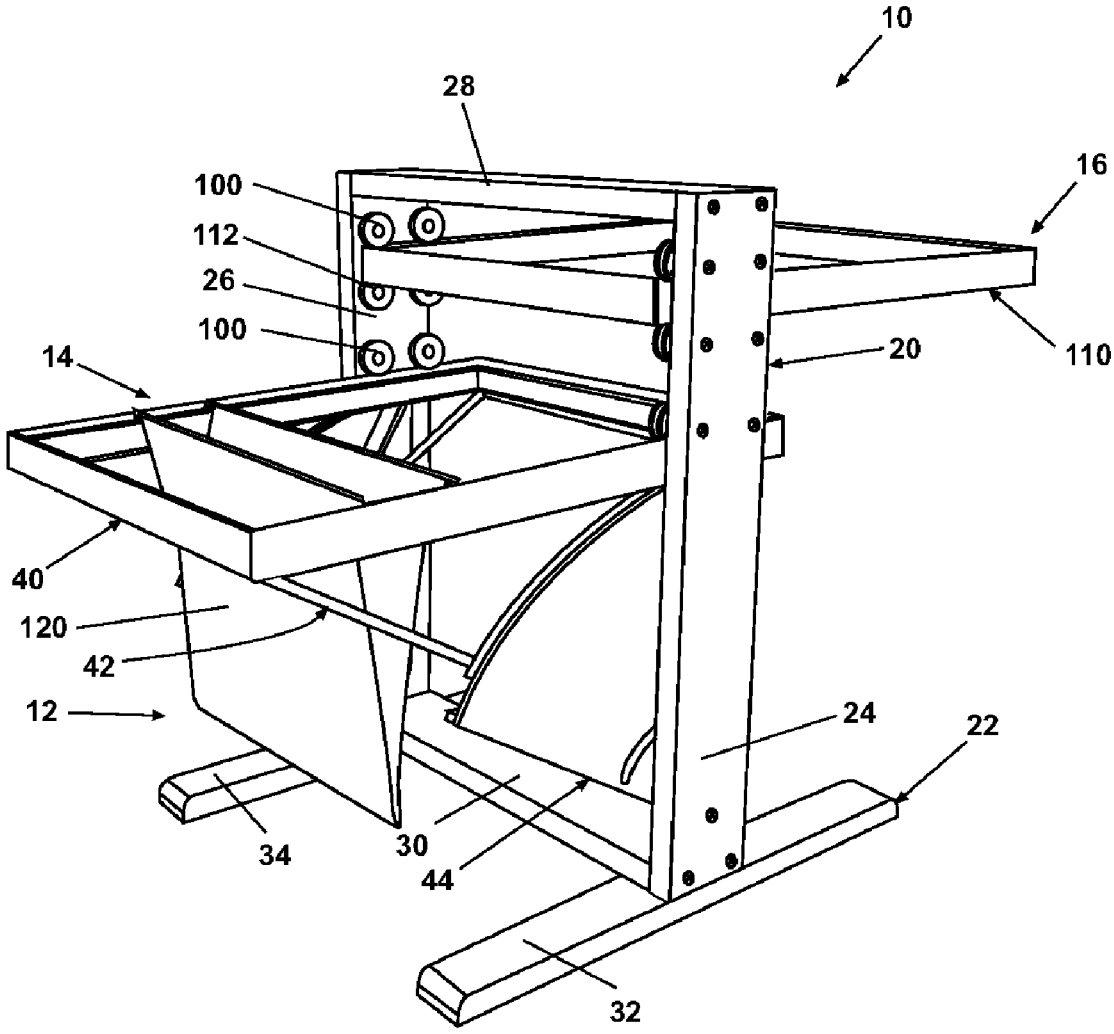
FIG. 9 is a perspective view of the cantilevered drawer assembly illustrated in FIG. 1 with the rotating drawer assembly supporting a hanging file in a transverse direction.
Figure 10:
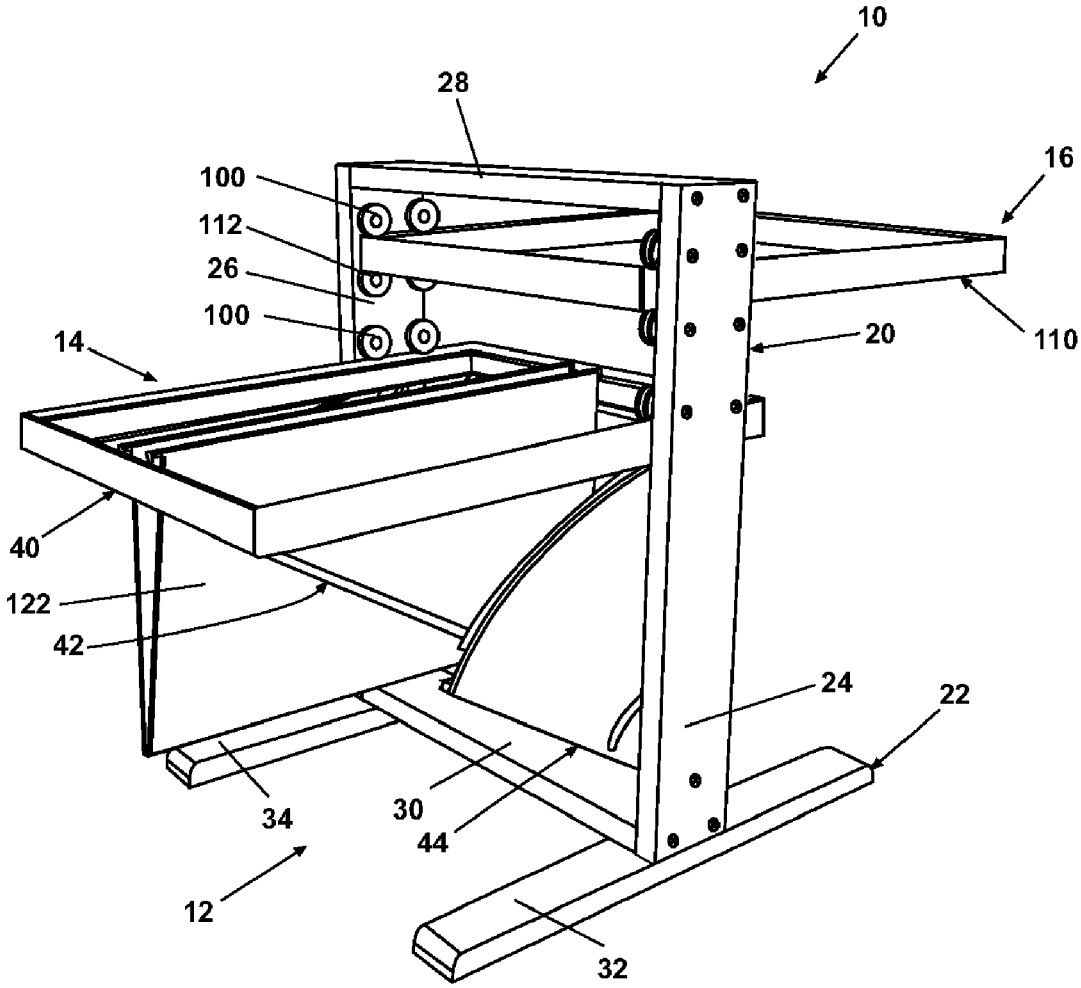
FIG. 10 is a perspective view of the cantilevered drawer assembly illustrated in FIG. 1 with the rotating drawer assembly supporting a hanging file in a longitudinal direction.

As illustrated in FIGS. 7 and 8, the drawer frame 40 can be translated from one side of the support frame assembly 12 to the other, thereby enabling the drawer frame 40 to be accessed from either side of the support frame assembly 12. As illustrated in FIG. 9, the drawer frame 40 can be utilized for suspending a hanging letter-size file 120 transverse to the direction of movement. It will be obvious that the lateral dimension of the drawer frame 40 and the length of the end rails 50, 52 will be selected based upon the size of the hanging file 120 to be suspended. The hanging file 120 can be suspended by supporting the hook ends of the hanging file 120 on the ledges 64. Referring to FIG. 10, the drawer frame 40 can also be utilized for suspending a legal-size hanging file 122 longitudinally to the direction of movement. It will be obvious that the longitudinal dimension of the drawer frame 40 and the length of the side rails 46, 48 will be selected based upon the size of the hanging file 122 to be suspended. The drawer frame 40 can also be adapted for insertion of a tub-like container (not shown) for holding solid objects. A container having a perimeter rim could be supported on the ledge 58, 64. Fabric mesh adapted to be supported by the drawer frame 40, such as with snaps or clips, could be used for irregular objects.

Figure 11:
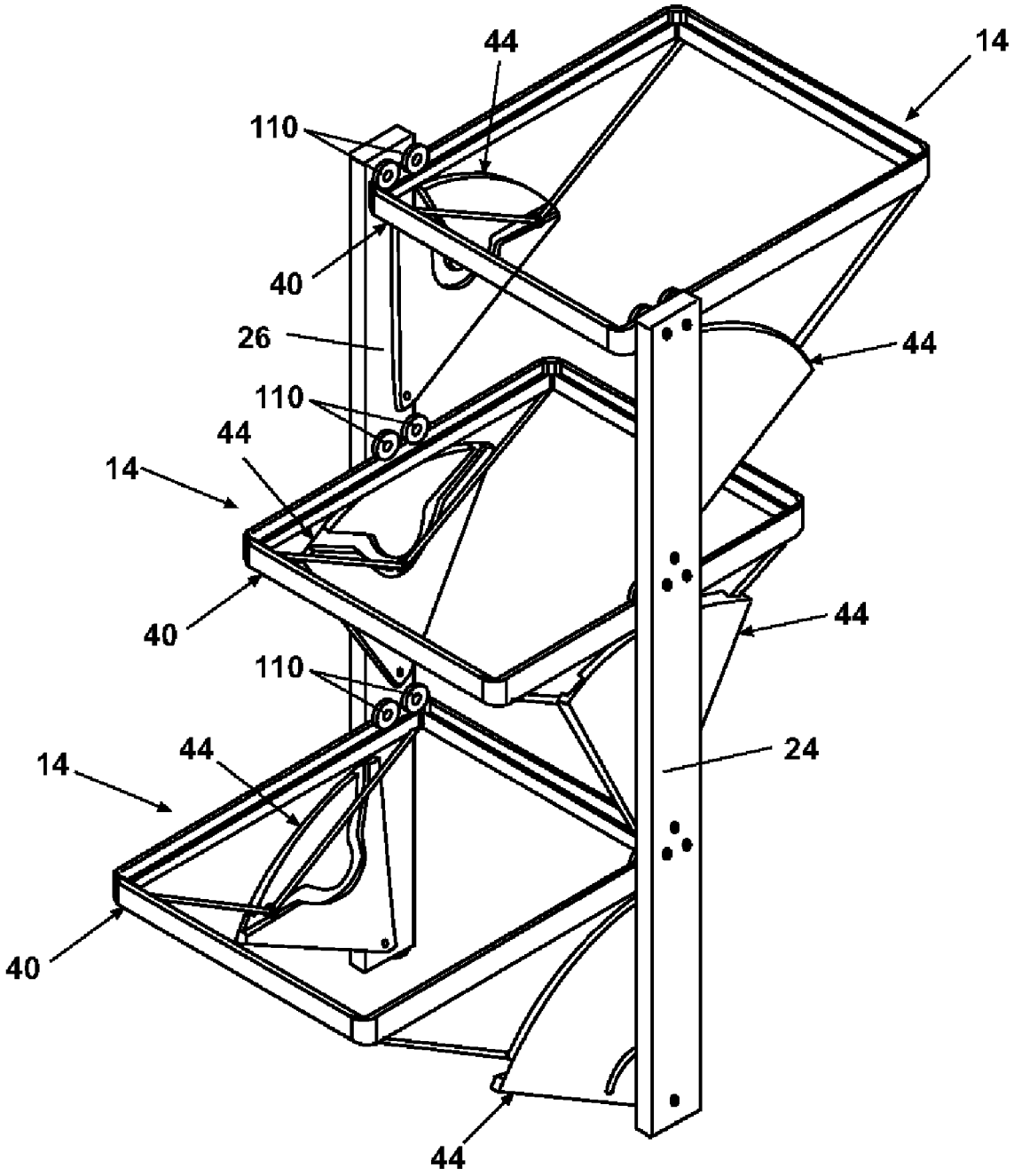
FIG. 11 is a perspective view of an embodiment of the invention comprising a cantilevered drawer assembly having a plurality of rotating drawer assemblies.
Figure 12:
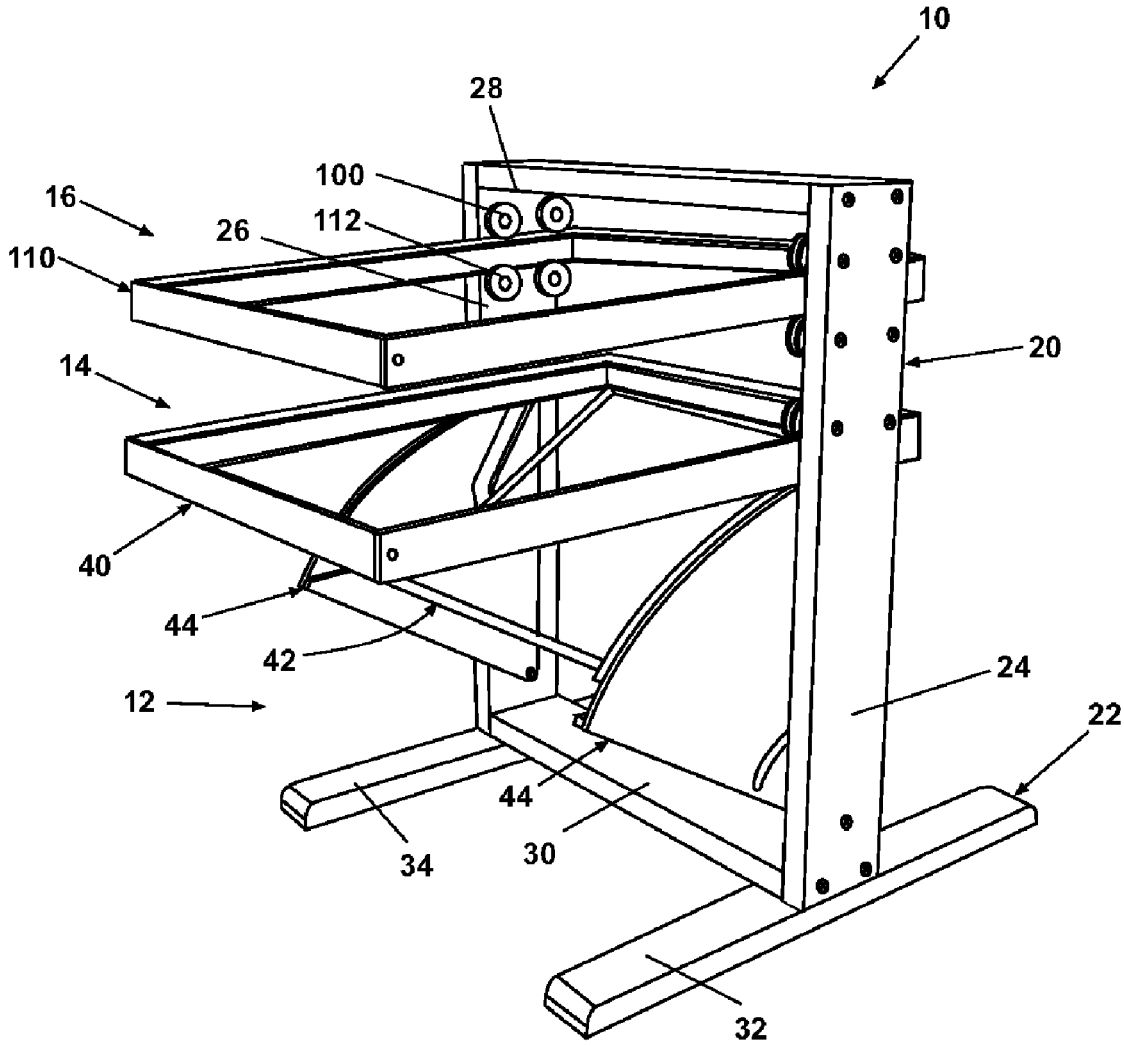
FIG. 12 is a perspective view of the cantilevered drawer assembly illustrated in FIG. 7 with the rotating drawer assembly and the sliding drawer assembly fully translated in the second direction.

As illustrated in FIG. 11, a plurality of drawer frames 40 can be suspended in a support frame assembly 12 having upright members 24, 26 adapted to accommodate the selected number of drawer frames 40.

Figure 13:
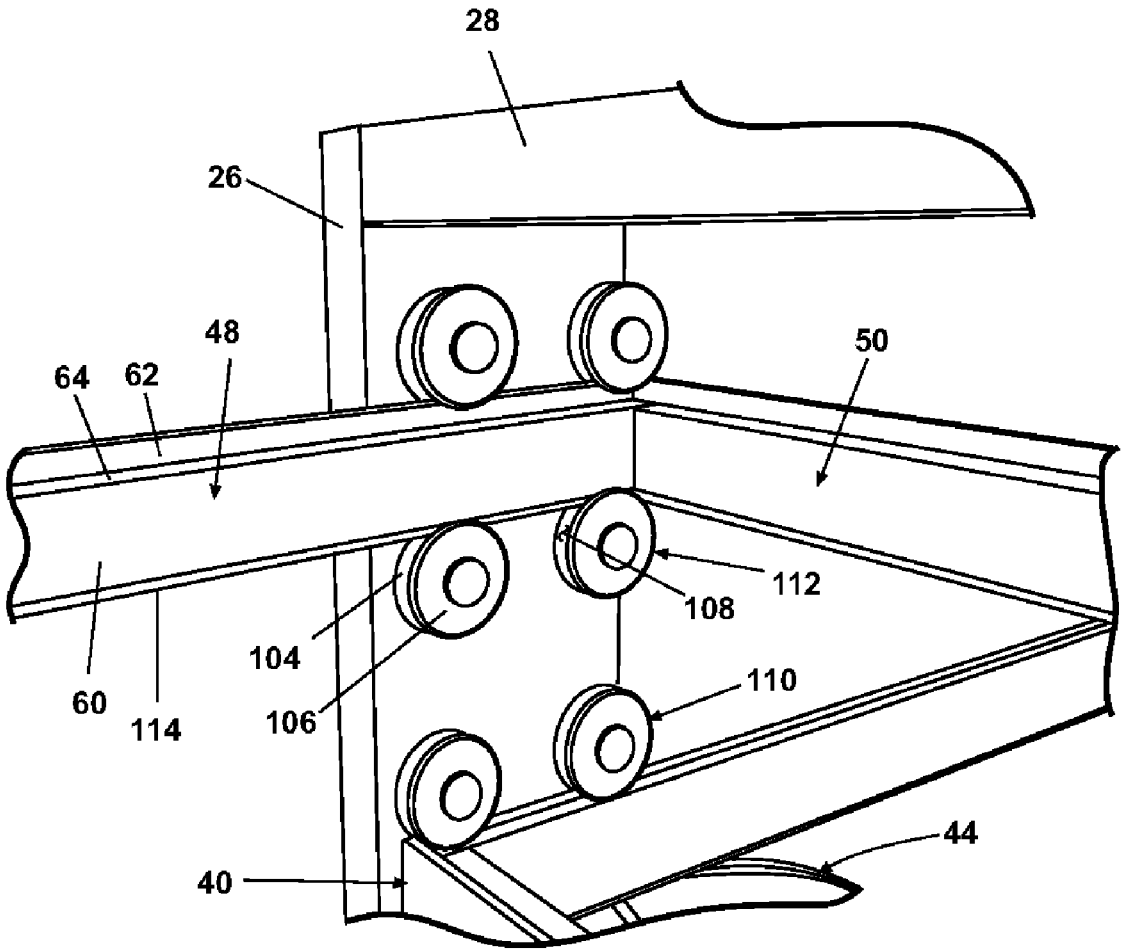
FIG. 13 is an enlarged perspective view of an assembly of wheels comprising a portion of the sliding drawer assembly illustrated in FIG. 1.

Referring now to FIGS. 1, 7–10, and 12, the sliding drawer assembly 16 comprises a drawer frame 110 similar in many respects to the drawer frame 40, with the exception of a flange portion 114 extending below the base portion 60 coplanar with the flange portion 62. The drawer frame 110 is received within the support frame assembly 12 similar to the drawer frame 40, with roller wheels 100 rotatably attached to the upright members 24, 26 to engage the flange portion 62. As illustrated in FIG. 13, support wheels 112 are rotatably attached to the upright members 24, 26 beneath the roller wheels 100 to engage the flange portion 114 in a manner similar to the engagement of the roller wheels 100 with the flange portion 62 to provide support to the drawer frame 110. The support wheels 112 are identical to the roller wheels 100. The configuration of the roller wheels 100 and the support wheels 112 is selected to maintain the drawer frame 110 in a horizontal plane during translation of the drawer frame 110 away from the support frame assembly 12. The support wheels 112 are illustrated arranged in pairs, although a fewer or greater number of support wheels 112 can be used.

Figure 14:
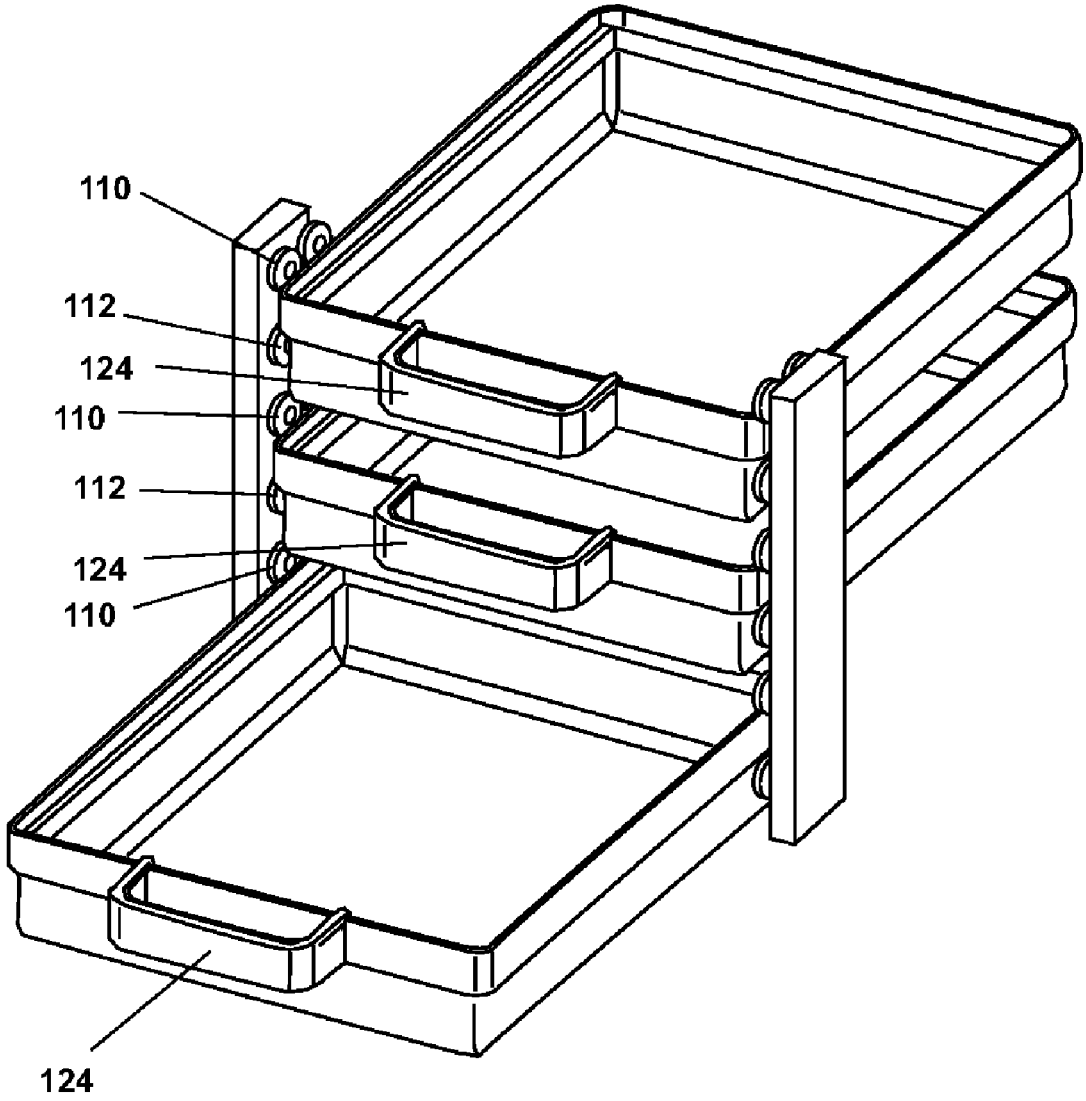
FIG. 14 is a perspective view of an embodiment of the invention comprising a cantilevered drawer assembly having a plurality of sliding drawer assemblies.

As illustrated in FIG. 14, the drawer frame 110 can actually be a bin provided with a handle 124 attached to one or both of the end rails 50, 52. Similarly, the open drawer frame 40 can be provided with a handle attached to one or both of the end rails 50, 52. A bin or an open frame can be mixed on the same support structure as needs demand.

Figure 15:
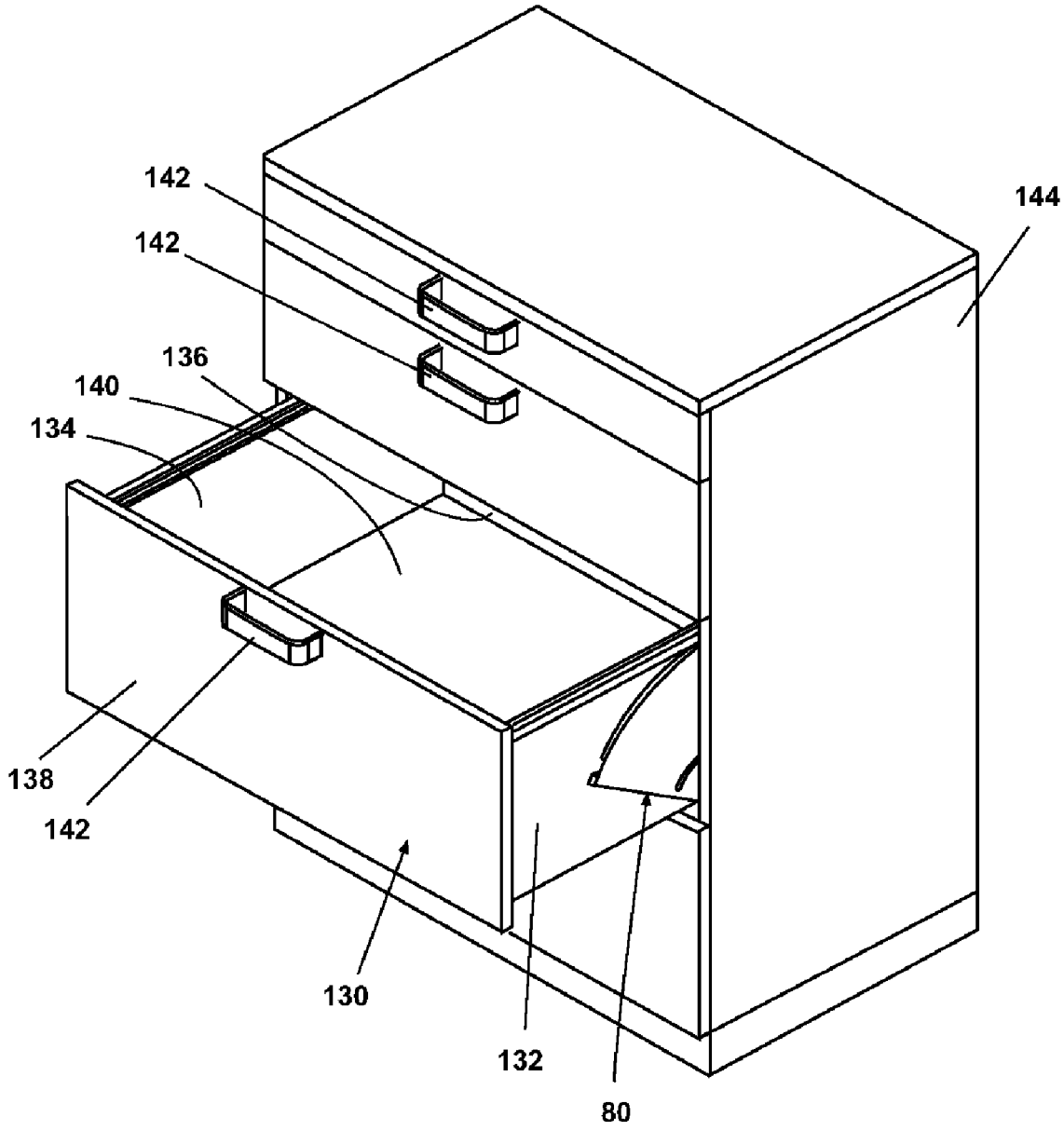
FIG. 15 is a perspective view of an embodiment of the invention comprising a cantilevered drawer assembly installed in a cabinet.

As illustrated in FIG. 15, the rotating drawer assembly 14 and the sliding drawer assembly 16 can be installed in a conventional cabinet 144. The size of the cabinet would be utilized rather than the upright members 24, 26 of a support frame assembly 12 to support the pivot arm assembly 44 and the wheels 100, 112. Additionally, the drawer frame 40 could be replaced by a drawer 130 supported and translatable by a pivot arm assembly 44 as described herein. The drawer 130 would be provided with side panels 132, 134 having a flange adapted to engage the wheels 100, 112 as previously described, a rear panel 136, a front panel 138, and a floor 140. The pivot wheels 102 would be attached to the side panels 132, 134 of the drawer 130 rather than to the pivot frame 42. The front panel 138 could be provided with a handle 142. Such a drawer 130 would be translatable in one direction out of the cabinet 144. Alternatively, the pivot arm assembly 44 could be adapted for translation of the drawer 130 in two directions in a cabinet having no back panel. Such a drawer would have two front panels 130 and two handles 142.

Figure 16:
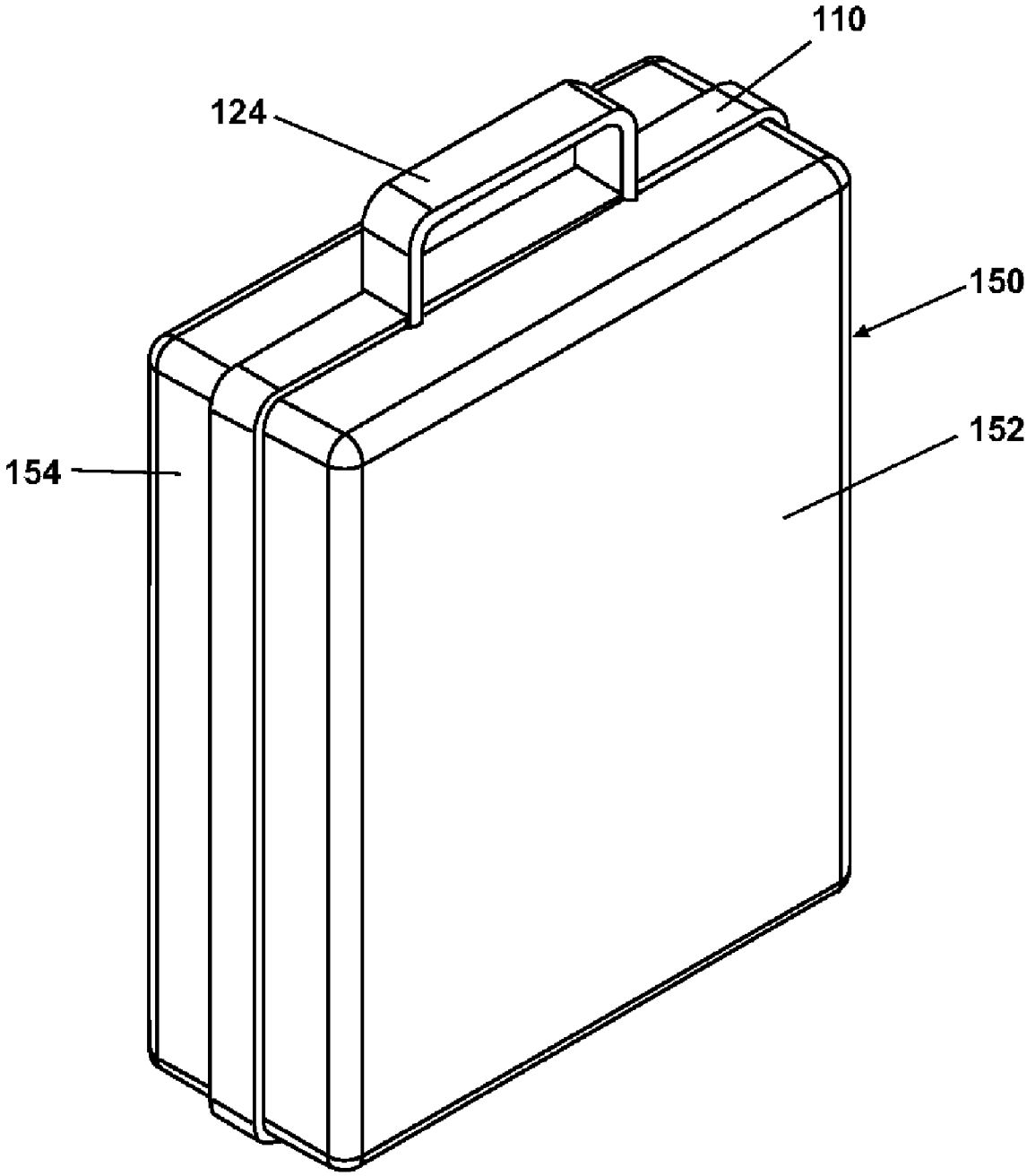
FIG. 16 is a perspective view of an embodiment of the invention comprising a sliding drawer assembly disposed in a portable carrying case.

FIG. 16 illustrates an embodiment of a bin 110 of the sliding drawer assembly of FIG. 14 in a portable drawer unit 150. Two portable drawer bins 152, 154 are positioned together, as a clam-shell, and mounted to each other to form the portable drawer unit 150. The handle 124 of the drawer frame 40, 110 would be used for carrying the portable drawer unit 150.

Figure 17:
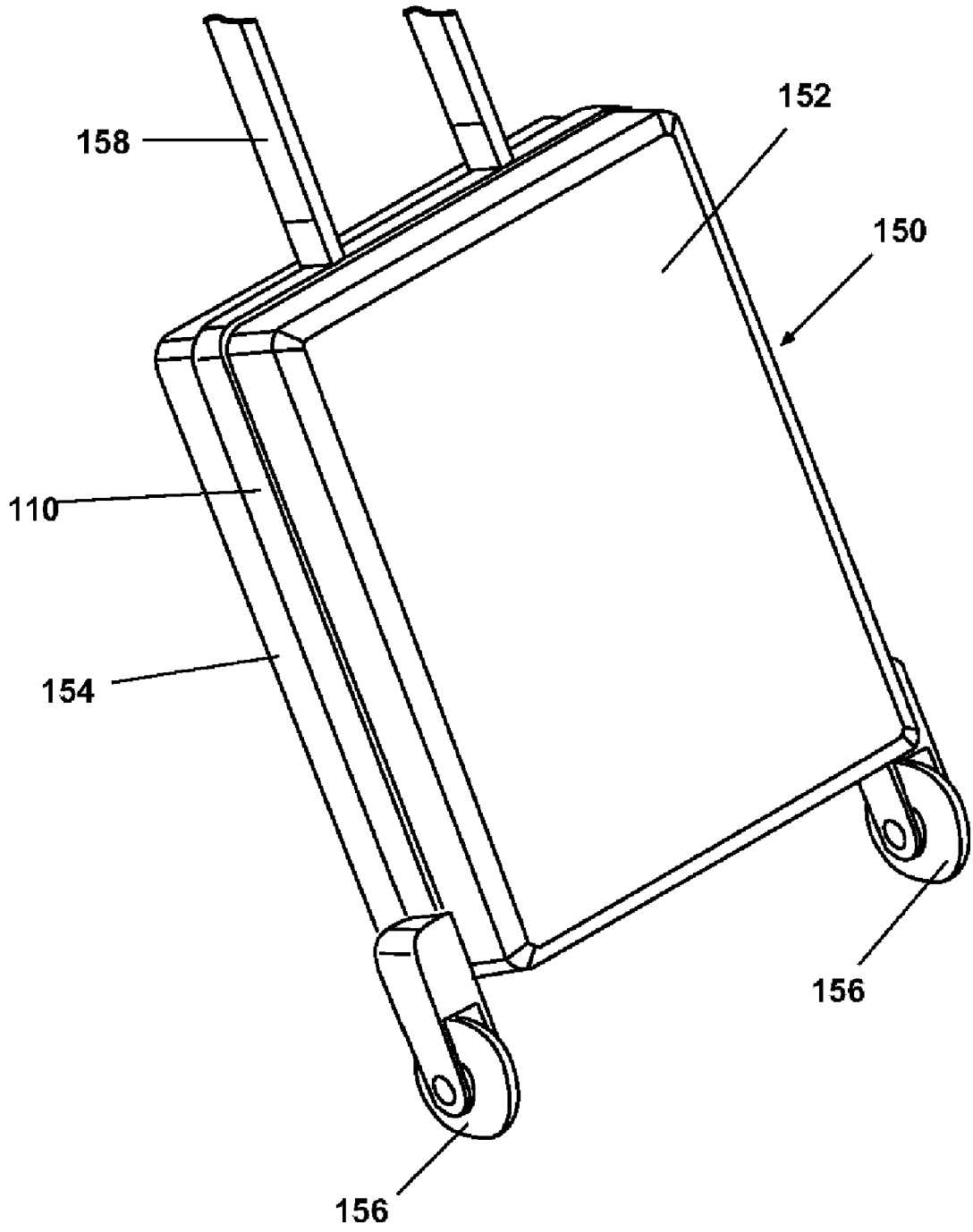
FIG. 17 is a perspective view of an embodiment of the invention comprising a sliding drawer assembly disposed in a rolling carrying case.

FIG. 17 illustrates another embodiment of a bin 110 of the sliding drawer assembly of FIG. 14 in a portable drawer unit 150 having a pair of wheels 156 and an extendable handle 158 for facilitating transportation of the drawer unit 150.

The upright members 24, 26 can have attachment elements so that side by side assemblies can be created by interconnecting upright members of adjoining cantilever drawer assemblies 10. The upright members 24, 26 can be attached to a base, connected to a panel or wall for support, or extended from floor to ceiling or to an overhead beam.

If frames 40, 110 are located at the proper height, wheelchair users can easily access the stored items. Large labels, possible color coded, open frames or translucent tubs, and universal handles can make storage more accessible to users with visual or physical impairments. As described and illustrated herein, the frames 40, 110 are supported from a single pair of upright members 24, 26. If an enclosed appearance is desired due to aesthetics or security concerns, a non-structural shroud can be attached to the support frame assembly 12 to cover the sides, back, and top of the assembly. A door can be attached to the support frame assembly 12 to close the front side.

The pivot frame 42 and the pivot arm assembly 44 can be used to extend a work surface in place of the frame 40, 110. In the cabinet embodiment of FIG. 15, a universal pull similar to the handle 124 can be attached to the frames 40, 110 to make them ADA compliant and more accessible. Alternatively, a flush pull can be used if desired for aesthetic and practical reasons.

The invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A cantilevered drawer assembly comprising:

a movable drawer having two sides;

a rotating wheel mounted to each side of the drawer;

a pair of pivot arms, each having the shape of a circular sector with an apex portion and comprising a channel traversing the pivot arm, at least a portion of which has a parabolic shape opening away from the apex; and a support for supporting the movable drawer, wherein each pivot arm is pivotally connected at the apex portion to the support, spaced from and facing each other; and wherein the movable drawer is disposed between the pivot arms, with a rotating wheel is received in the channel of the adjacent pivot arm;

whereby each rotating wheel is free to move along the channel as the pivot arm rotates about the apex portion, the parabolic portion thereby enabling the movable drawer to translate in a plane relative to the support, while being cantilevered to the support.

2. The cantilevered drawer assembly according to claim 1, wherein each pivot arm has an arcuate edge and a drawer side is supported by the arcuate edge.

3. The cantilevered drawer assembly according to claim 1, and further comprising a flanged wheel rotatably attached to the support to engage an upper edge of each drawer side to restrict the vertical movement of the drawer.

* * * * *

UNITED STATES PATENT AND TRADEMARK OFFICE

CERTIFICATE OF CORRECTION

PATENT NO. : 7,156,244 B1
APPLICATION NO. : 11/163077
DATED : January 2, 2007
INVENTOR(S) : Randall Nelsen It is certified that error appears in the above-identified patent and that said Letters Patent is hereby corrected as shown below:

Claim 1, Column 8, line 11, reads: "...with a rotating wheel is received in the…"

It should read --...with a rotating wheel received in the…--

Signed and Sealed this

Twenty-seventh Day of February, 2007

JON W. DUDAS
*Director of the United States Patent and Trademark Office*